US009183842B2

(12) United States Patent
Ip et al.

(10) Patent No.: US 9,183,842 B2
(45) Date of Patent: Nov. 10, 2015

(54) TRANSCODER WITH DYNAMIC AUDIO CHANNEL CHANGING

(75) Inventors: Kent Ip, Pak Shek Kok (HK); Kenny Lo, Pak Shek Kok (HK)

(73) Assignee: VIXS Systems Inc., Toronto (CA)

( * ) Notice: Subject to any disclaimer, the term of this patent is extended or adjusted under 35 U.S.C. 154(b) by 286 days.

(21) Appl. No.: 13/291,796

(22) Filed: Nov. 8, 2011

(65) Prior Publication Data

US 2013/0117032 A1 May 9, 2013

(51) Int. Cl.
*G10L 21/00* (2013.01)
*G10L 19/16* (2013.01)
*G10L 19/008* (2013.01)

(52) U.S. Cl.
CPC ..... *G10L 19/173* (2013.01); *G10L 19/008* (2013.01); *G10L 19/167* (2013.01)

(58) Field of Classification Search
CPC ..... G10L 19/173; G10L 19/24; G10L 19/02; H04S 2420/03; H04L 43/0829; H04L 43/087; H03G 3/3089
USPC ..... 704/501, 500, 503, 270, 223, 201, 94; 725/151; 712/29; 710/72; 709/224, 709/223; 455/435.1; 386/232; 381/23, 22, 381/2, 103; 380/200; 379/189; 375/240.26, 375/240.02; 370/349; 348/512; 341/143
See application file for complete search history.

(56) References Cited

U.S. PATENT DOCUMENTS 5,644,310 A * 7/1997 Laczko et al. ..... 341/143
5,887,187 A * 3/1999 Rostoker et al. ..... 712/29
6,236,432 B1 * 5/2001 Lee ..... 375/240.26
6,434,645 B1 * 8/2002 Parvin et al. ..... 710/72
6,704,421 B1 * 3/2004 Kitamura ..... 381/103
6,735,291 B1 * 5/2004 Schmid et al. ..... 379/189
6,823,310 B2 * 11/2004 Ishito et al. ..... 704/270
7,394,903 B2 * 7/2008 Herre et al. ..... 381/23
8,086,331 B2 * 12/2011 Ikeda et al. ..... 700/94
8,108,221 B2 * 1/2012 Chen et al. ..... 704/500
8,150,702 B2 * 4/2012 Zhou et al. ..... 704/503
8,180,061 B2 * 5/2012 Hilpert et al. ..... 381/22
2004/0033057 A1 * 2/2004 Kojo et al. ..... 386/111
2004/0073641 A1 * 4/2004 Minhazuddin et al. ..... 709/223
2006/0259168 A1 * 11/2006 Geyersberger et al. ..... 700/94
2007/0003057 A1 * 1/2007 Lemma et al. ..... 380/200
2007/0014274 A1 * 1/2007 Choi ..... 370/349
2008/0005310 A1 * 1/2008 Xu et al. ..... 709/224
2008/0107173 A1 * 5/2008 van Beek ..... 375/240.02
2008/0175395 A1 * 7/2008 Rice ..... 381/2
2009/0210234 A1 * 8/2009 Sung et al. ..... 704/500
2009/0270099 A1 * 10/2009 Gallagher et al. ..... 455/435.1
2009/0271184 A1 * 10/2009 Goto et al. ..... 704/223
2010/0083344 A1 * 4/2010 Schildbach et al. ..... 725/151
2011/0221959 A1 * 9/2011 Ben Yehuda et al. ..... 348/512
2012/0109643 A1 * 5/2012 Yi et al. ..... 704/201

* cited by examiner

*Primary Examiner* — Michael Colucci

(57) ABSTRACT

A transcoder is arranged to transcode a stream having a dynamically changing audio configuration, such as a changing number of audio channels. The transcoder can receive an input stream whereby changes in the content associated with the input stream causes corresponding changes to the configuration of audio data encoded in the input stream. The transcoder is arranged to detect the change in audio configuration and, in response, to dynamically reconfigure its decoder and encoder modules to continue to transcode the audio data after the audio configuration change.

18 Claims, 6 Drawing Sheets

| Channel configuration index | Channel number | | | | | |
|---|---|---|---|---|---|---|
| | 1 | 2 | 3 | 4 | 5 | 6 |
| 1/0 | C | | | | | |
| 1/1 (dual mono) | L | R | | | | |
| 2/0 (stereo) | L | R | | | | |
| 2/1 | L | R | LFE | | | |
| 3/0 | L | R | C | | | |
| 2/2 | L | R | LS | RS | | |
| 3/1 | L | R | C | LFE | | |
| 3/2 | L | R | C | LS | RS | |
| 3/2+LFE | L | R | C | LS | RS | LFE |

500

FIG. 5

TRANSCODER WITH DYNAMIC AUDIO CHANNEL CHANGING

FIELD OF THE DISCLOSURE

This disclosure, in general, relates to transcoding and more particularly to audio transcoding.

BACKGROUND

Multimedia devices sometimes employ a transcoder to perform digital-to-digital conversion of data, such as video and audio data, from one encoding format to another. Transcoding can be useful to, for example, allow a processing device to process data in an encoding format that is not natively supported by the processing device. Transcoding can also be employed to reduce the amount of data to be processed for devices with limited storage capacity.

BRIEF DESCRIPTION OF THE DRAWINGS

The present disclosure may be better understood, and its numerous features and advantages made apparent to those skilled in the art by referencing the accompanying drawings.

FIG. 5 is a diagram illustrating a mapping of audio channel configurations to a set of channel tags for the transcoder of FIG. 1 in accordance with one embodiment of the present disclosure.

The use of the same reference symbols in different drawings indicates similar or identical items.

DESCRIPTION OF THE PREFERRED EMBODIMENT(S)

In an exemplary embodiment, a transcoder is arranged to transcode a stream having a dynamically changing audio configuration, such as a changing number of audio channels. To illustrate, the transcoder can receive an input stream representing a television channel whereby changes in the television channel content causes corresponding changes to the configuration of audio data encoded in the input stream. For example, some of the television channel content (e.g. a particular television program) can be encoded with an audio configuration that employs two audio channels (such as stereo left and right channels) while other content (e.g. a different television program) is encoded with an audio configuration having a different number of audio channels (such as individual audio channels for 6 different speakers). The transcoder is arranged to detect the change in audio configuration in the input stream and, in response, to dynamically reconfigure its decoder and encoder modules to continue to transcode the audio data after the audio configuration change.

Figure 1:
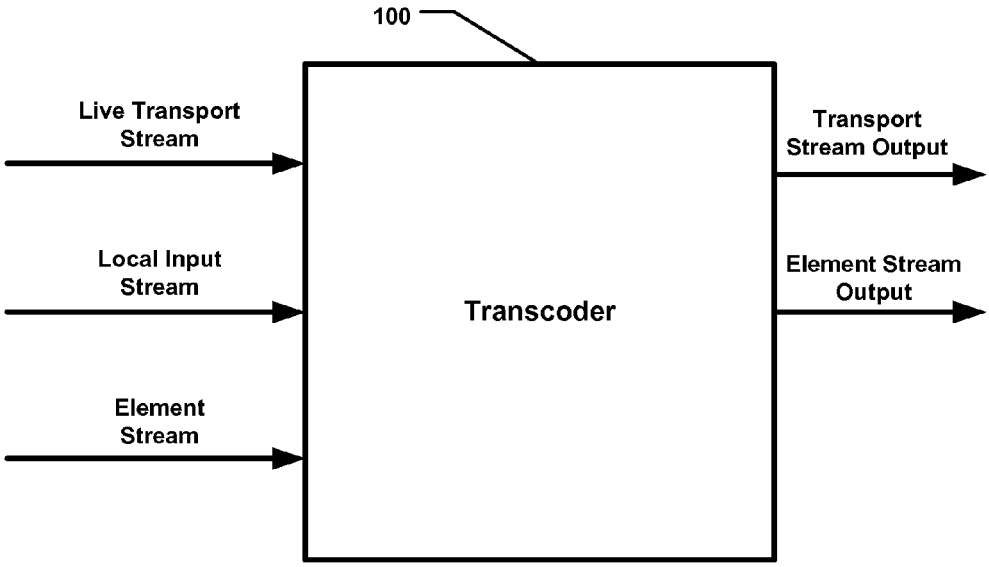
FIG. 1. is a block diagram of a transcoder in accordance with one embodiment of the present disclosure.

FIG. 1 illustrates a block diagram of a transcoder 100 in accordance with one embodiment of the present disclosure. The transcoder 100 can be incorporated in any of a variety of data processing devices, such as television sets, television tuner cards, computer devices, set top boxes, or any other device arranged to process audio and video data for eventual storage or presentation to a user. The transcoder 100 is generally arranged to transcode an input stream including at least audio data. In the illustrated example, the transcoder 100 can receive one or more types of input streams, including a live transport stream, a local input stream, and an element stream.

The live transport stream is a stream of multiplexed multimedia information (audio and video data) encoded according to a particular encoding format. Examples of encoding formats include Moving Picture Experts Group (MPEG) Audio Layer 2 (MP2), Advanced Audio Coding (AAC), High-efficiency Advanced Audio Coding (HE-AAC), Audio Coding 3 (AC-3), Enhanced AC-3 (E-AC-3), and the like. The live transport stream can originate from any of a number of multimedia sources, such as a broadcast television source, a wide area network, and the like, and be provided via a corresponding interface, such as network gateway (e.g., a cable modem or digital subscriber line), a wireless interface (e.g., an IEEE 802.11 interface), a television tuner, or other module configured to provide a physical layer interface for reception of multimedia information. In an embodiment, the multimedia information incorporated in the live transport stream is representative of content generated at a content provider, such as a set of television programs, a pay-per-view movie, a webcast, and the like.

The local input stream is an encoded stream of multimedia information representing multimedia information produced at a local device. As used herein, a local device refers to a device that communicates with the transcoder 100 via a generally local connection, such as an internal device bus, a universal serial bus (USB) or other local computer interface, and the like. Accordingly, the source of the local input stream can be a local storage medium, such as a hard drive, solid state disk, digital versatile disk (DVD), and the like. The local input stream is therefore representative of locally stored multimedia content, such as a computer multimedia file, a television program or a movie recorded by a digital video recorder (DVR), and the like.

The element stream is a stream of elementary data (e.g. audio data) that represents a multimedia element, and is not multiplexed with other multimedia elements (e.g. video data). Accordingly, the source of the elementary data can be an audio or other multimedia file, or can be audio data extracted from a transport stream at another device, such a local processor (not illustrated).

The element stream, live transport stream, and local input stream are generally referred to as input streams. It will be appreciated that, although transcoder 100 is illustrated as receiving three input streams, in some embodiments the transcoder 100 can receive fewer or more than the illustrated input streams. In other embodiments, the transcoder 100 receives only one of the illustrated input streams at a time. In still other embodiments, the transcoder 100 can receive and transcode two or more of the input streams concurrently. For purposes of discussion, it is assumed that the transcoder 100 receives and transcodes a single input stream at a time. The input stream is generally encoded according to a particular encoding format, referred to herein as the input encoding format.

In the illustrated embodiment, the transcoder 100 provides two output streams, including a transport stream output and an elementary stream output. The transport stream output includes multiplexed transcoded audio and video information. The transport stream output can be locally stored at a hard drive or other storage medium, or can be provided to another device via a wide-area or local-area network, via a cable connection (e.g. a USB or High-Definition Multimedia Interface (HDMI) cable), and the like, or can be provided for further processing to a local processor via an internal bus.

The element stream output includes transcoded audio information based upon the input stream. The element stream can be stored as an audio file at a hard drive or other storage medium, or can be provided to a local resource, such as a software application being executed at a local processor. The transport stream output and element stream output are generally referred to as output streams. It will be appreciated that, although transcoder 100 is illustrated as generating two output streams, in some embodiments the transcoder 100 can receive fewer or more than the illustrated number of output streams. In other embodiments, the transcoder 100 generates only one of the illustrated input streams at a time. In still other embodiments, the transcoder 100 can generate two or more of output streams concurrently. For purposes of discussion, it is assumed that the transcoder 100 generates a single output stream at a time. The output stream is generally encoded according to a particular encoding format, referred to herein as the output encoding format.

In operation, the transcoder 100 transcodes the received input stream to transform the input encoding format to the output encoding format. In one embodiment, the output encoding format conforms to a different encoding specification than the input encoding format. In another embodiment, the output encoding format and input encoding format conform to a common encoding specification, but have different sample rates, bit rates, and number of audio channels.

Figure 2:
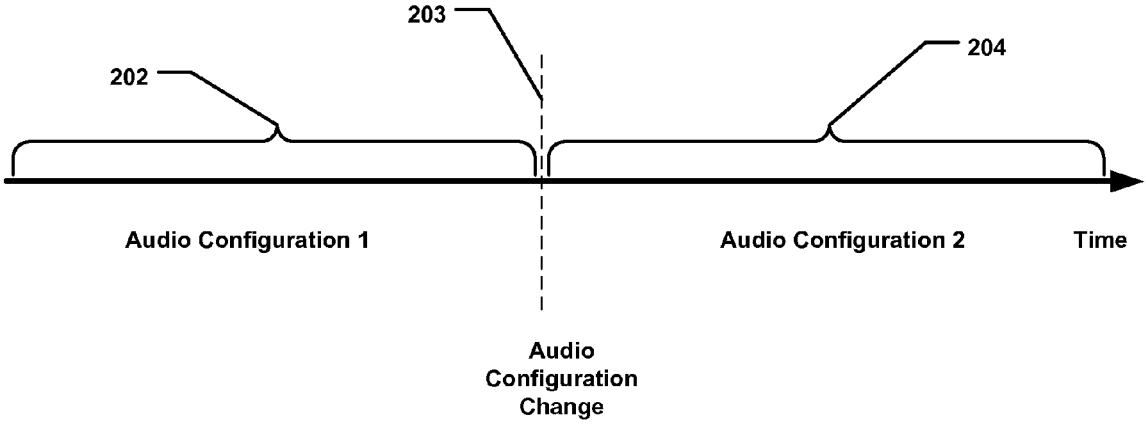
FIG. 2 is a diagram illustrating a change in audio configuration for data received by the transcoder of FIG. 1 in accordance with one embodiment of the present disclosure.

Further, the transcoder 100 is arranged so that it can automatically reconfigure its constituent modules to continue to transcode the input stream as the audio configuration of the input stream changes. To illustrate, the transcoder 100 can be incorporated in a multimedia device, such as a set top box, such that the input stream corresponds to a broadcast television channel. As the content provided via the television channel changes, the audio configuration of the input stream can also change. In particular, the number of audio channels associated with the encoded input audio data can change. For example, one program provided by the television channel may result in the audio configuration of the input stream having stereo sound, while an ensuing program results in the audio configuration of the input stream having 5.1 surround sound. Accordingly, in response to a change in the content represented by the input stream, a corresponding change in the audio configuration occurs. This is illustrated at FIG. 2, which illustrates a timeline of the audio configuration for the input stream. During time 202, the audio portion of the input stream is associated with a configuration designated Audio Configuration 1. At time 203, in response to a change in the content associated with input stream, the audio portion undergoes a configuration change, thereby changing a number of audio channels represented by the input stream. The change in content can represent, for example, a change in a television program being provided by the input stream.

Accordingly, during time 204, the audio configuration of the input stream is associated with Audio Configuration 2, different from Audio Configuration 1. As described further herein, the change in audio configuration may be represented both by a change in the audio data that represents the audio portion of the multimedia content and by a change in header or other control information for the audio data. For example, some audio encoding formats indicate the number of audio channels for the input stream in a code value stored in a header of a data block. Accordingly, the change in audio configuration can be indicated by a change in the code value.

In response to the change in audio configuration for the input stream, the transcoder 100 is configured to automatically (e.g. without user input or receipt of an external instruction from a processor device) and dynamically (e.g. without shutdown or hard reset) reconfigure its constituent modules to transcode the audio data from the new encoding format to the output format. That is, in response to receiving the audio data during time period 202, the transcoder 100 transcodes the audio data having the number of audio channels indicated by Audio Configuration 1 to the output encoding format. In response to the audio format change at time 203 the transcoder 100 automatically and dynamically reconfigure its constituent modules so that, in response to receiving the audio data during time period 204, it transcodes having the number of audio channels indicated by Audio Configuration 1 to the output encoding format. Thus, in one embodiment, the Audio Configuration 1 is associated with a particular number of audio channels (e.g. two audio channels, such as for stereo sound) while Audio Configuration 2 is associated with a different number of audio channels (e.g. 5 or 6 channels, such as for surround sound).

Figure 3:
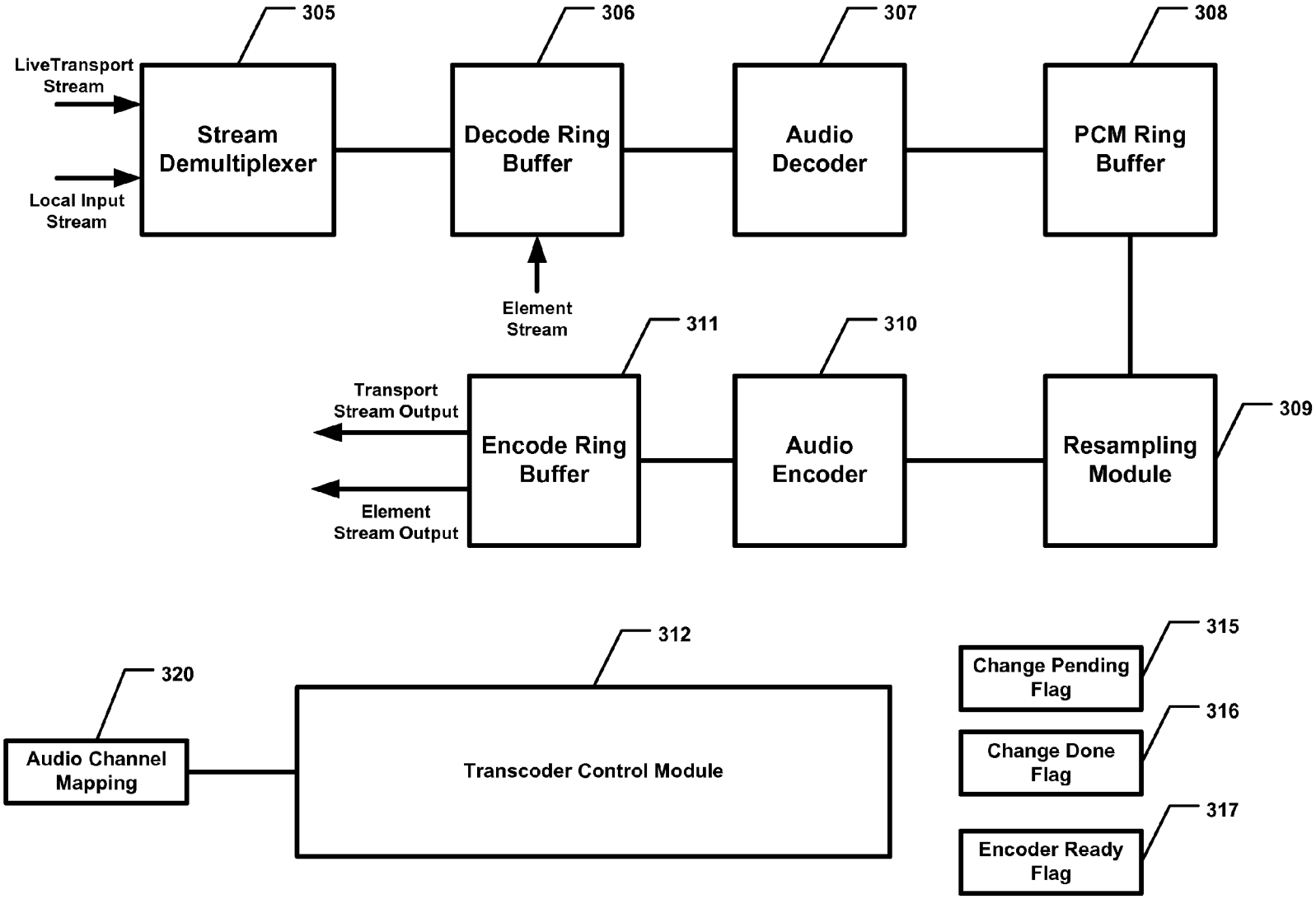
FIG. 3 is a block diagram illustrating additional details of the transcoder of FIG. 1 in accordance with one embodiment of the present disclosure.

FIG. 3 illustrates the transcoder 100 according to one embodiment of the present disclosure. The transcoder 100 includes a stream demultiplexer 305, a decode ring buffer 306, an audio decoder 307, a pulse code modulated data (PCM) ring buffer 308, a resampling module 309, an audio encoder 310, an encode ring buffer 311, and a transfer control module 312. The stream demultiplexer 305 is configured to receive the live transport stream and the local input stream and to extract the audio data from the combined audio and video data included in the input stream. For purposes of discussion, it is assumed that the extracted audio data is arranged according to discrete data values, referred to as audio samples or simply samples. The stream demultiplexer 305 provides the extracted audio samples at its output. In an embodiment, the stream demultiplexer 305 can also extract the video data from the received input stream and provide the extracted video data to another set of modules (not illustrated) for transcoding.

The decode ring buffer 306 is a memory structure configured to store audio samples received from the stream demultiplexer 305. The buffer 306 is arranged as a ring buffer accessible according to a pair of pointers, whereby one pointer (the write pointer) indicates the next location where an audio sample is to be stored and another pointer (the read pointer) indicates the location from which data is to be retrieved. As samples are stored and retrieved in the buffer 306, the buffer automatically adjusts the values of the write and read pointers so that the samples are stored and retrieved in a designated fashion, such as a first-in-first out (FIFO) arrangement.

The audio decoder 307 is configured to retrieve audio samples stored at the decode ring buffer 306 and transform the retrieved samples, based on their corresponding audio encoding format, to a set of pulse code modulated (PCM) samples. The audio decoder 307 is configured such that it can detect the encoding format for each received sample, and can be automatically and dynamically reconfigured to decode data in any one of a plurality of audio encoding formats. Thus, for example, in response to determining that the input stream is encoded according to the AAC format, the audio decoder 307 will configure its constituent modules (not shown) to provide, at its output, properly decoded PCM samples based on the AAC format.

The PCM ring buffer 308 is a memory structure configured to store PCM samples received from the audio decoder 307. The buffer 306 is arranged as a ring buffer accessible using at least a pair of pointers, whereby one pointer (the write pointer) indicates the next location where an audio sample is to be stored and another pointer (the read pointer) indicates the location from which data is to be retrieved. As samples are stored and retrieved in the buffer 306, the buffer automatically adjusts the values of the write and read pointers so that the samples are stored and retrieved in a designated fashion, such as a first-in-first out (FIFO) arrangement. In response to a reset of the transcoder 100, the read and write pointers are reset to an initial position, such as consecutive or contiguous positions of the buffer 308. As described further herein, the read and write pointers can also be reset to their initial position in response to a change in audio encoding format for the received input stream.

The audio encoder 310 is configured to retrieve PCM samples stored at the PCM ring buffer 308 and transform the retrieved samples to the output encoding format. The audio encoder 307 is configured such that it can be automatically and dynamically reconfigured to encode data in any one of a plurality of audio encoding formats, as described further herein.

The encode ring buffer 311 is a memory structure configured to store audio samples received from the audio encoder 310. The buffer 311 is arranged as a ring buffer accessible according to a pair of pointers, in similar fashion to the decode ring buffer 306. As samples are stored and retrieved in the buffer 306, the buffer automatically adjusts the values of the write and read pointers of the buffer so that the samples are stored and retrieved in a designated fashion, such as a first-in-first out (FIFO) arrangement. The samples stored at the buffer 311 are retrievable by one or more modules or software programs, thereby forming one or more output streams. Thus, for example, the stored samples can be provided to a multiplexer for combination with transcoded video data to form the output transport stream. The samples can also be retrieved to form an element stream output for provision to, for example, an application program being executed at the local device that includes the transcoder 100.

The transcoder control module 312 is a module configured to control the operations and flow of data through the transcoder 100. It will be appreciated that although for clarity purposes individual connections with the transcoder control module 312 are not shown, the module 312 is able to communicate with, and control the configuration and operations of, each of the illustrated modules. In some embodiments, the operations of the transcoder control module 312 can be distributed among one or more of the other illustrated modules.

In the illustrated example of FIG. 2, the transcoder 100 includes a channel mapping 320, stored at a memory device such as a hard disk or random access memory. The channel mapping 320 indicates the number of audio channels included in the input stream, and the mapping of each audio channel to a particular tag value, indicating the relative spatial position or other differentiating characteristic for each channel. The channel mapping 320 is described further below with respect to FIG. 5. The channel mapping 320 is maintained by the transcoder control module 312 to reflect the current audio encoding format for the input stream. The channel mapping 320 is accessed by the audio decoder 307 and the audio encoder 310 to ensure that audio samples are decoded and encoded properly according to the number of audio channels associated with the input stream.

Figure 4:
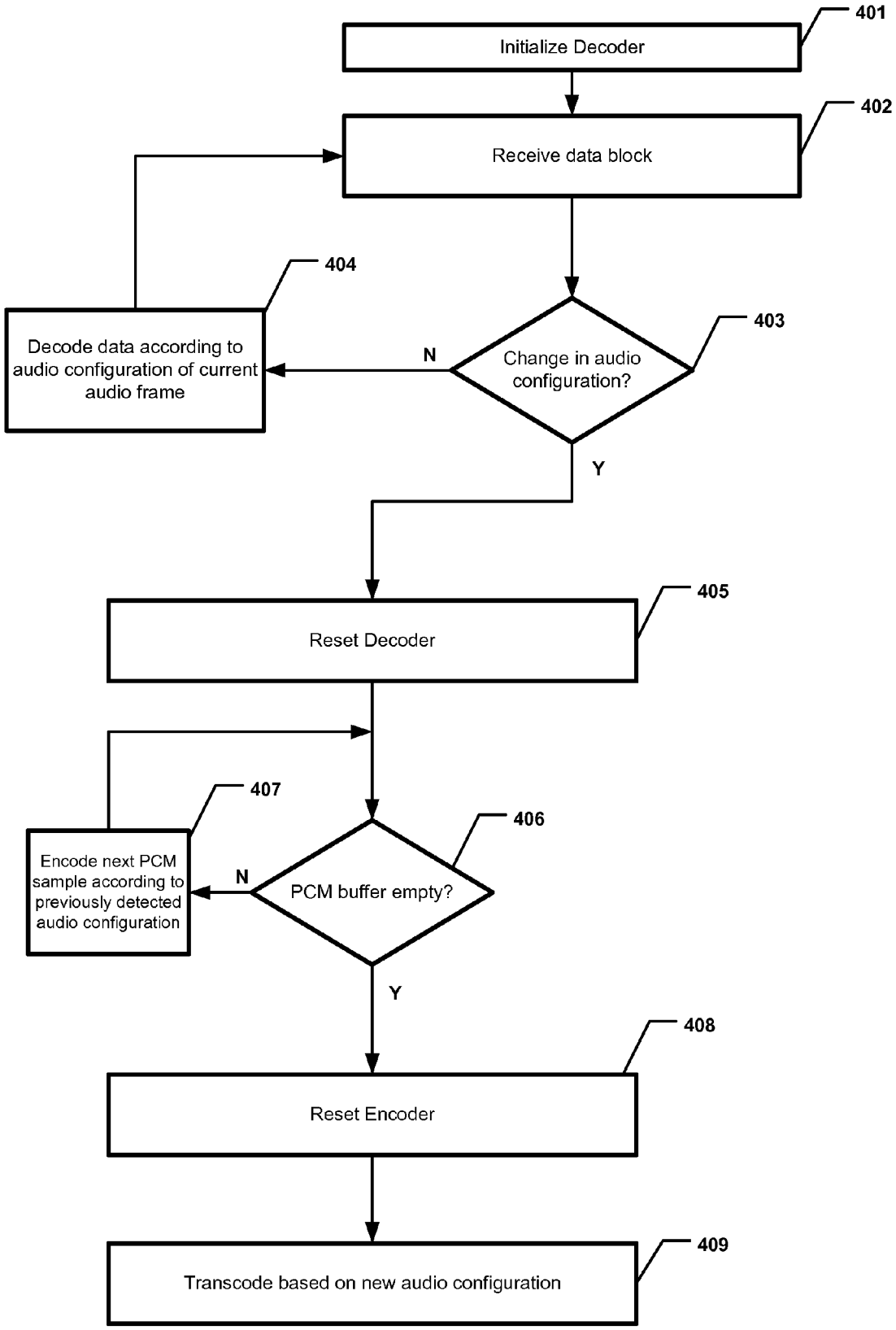
FIG. 4 is a flow diagram illustrating a method of transcoding audio data in response to a change in audio configuration for the input stream at the transcoder of FIG. 1 in accordance with one embodiment of the present disclosure.

In operation, the transcoder control module 312 is configured to reconfigure the audio decoder 307, the encoder 310, and the other modules in response to a change in audio encoding format for the received input stream. This can be better understood with reference to FIG. 4, which illustrates a method of transcoding audio data in accordance with one embodiment of the present disclosure. At block 401 the audio decoder 307 is initialized. At block 402, the demultiplexer 305 receives a block of data via the input stream. In response, the demultiplexer 305 extracts audio samples from the input stream and stores the audio samples at the decode ring buffer 306. At block 404, the audio decoder 307 analyzes one or more of the stored audio samples to determine whether there has been a change in the audio encoding format for the input stream. In an embodiment, the audio decoder determines whether there has been a change by determining the audio encoding format, determining a number of channels for the encoding format, mapping the channels to a set of tags, and determining whether the mapped tags indicate a change in audio encoder configuration. This can be better understood with reference to FIG. 5, which illustrates a table 500 indicating the mapping of a set of tags (tags "C", "L", "R", "LS", "RS", and "LFE"). The columns indicate a number of channels associated with the encoding format, and the rows indicate a channel configuration index.

Thus, for example, the AAC (MPEG-2) encoding format defines its audio channels using a single channel element (SCE), a channel pair element (CPE), and a low frequency element (LFE). The AAC encoding format therefore includes 3 channels, and can therefore be mapped to the configuration index 2/1 or 3/0. Therefore the SCE element can be mapped to the L tag, the CPE element can be mapped to the R tag, and the LFE element mapped to the LFE tag. Other encoding formats that employ three channel elements can be mapped similarly, while encoding formats having a different number of elements will be mapped to different tag sets. Thus, for example, the AC-3 encoding format employs a three bit configuration identifier to identify the supported channels in the format. Depending on the particular value of the three bit identifier, the number of channels supported in the encoding format will change, and therefore the particular tag set mapped to the format can change.

It will be appreciated that different encoding formats can be mapped to a common set of tags. For such encoding formats, the audio encoder 307 will determine that no change in the channel mapping has occurred, and therefore the transcoder 100 will not reconfigure its modules to change to the number of channels to be decoded.

Returning to FIG. 4, if the audio decoder 307 determines that the configuration of audio channels for the input stream has not changed, the method flow moves to block 403 and the transcoder 100 continues to transcode audio data according to the previously detected channel configuration. If the audio decoder determines that the configuration of audio channels has changed, the method flow moves to block 405 and the transcoder control module 312 resets the configuration of the audio decoder 307 so that it will be ready to decode the audio data according to the detected audio configuration.

At block 406, the transcoder control module 312 determines whether the PCM ring buffer 308 has been emptied of PCM samples decoded according to the previously detected audio configuration. If not, the method flow moves to block 407 and the audio encoder 310 continues to encode PCM samples retrieved from the buffer 308 based on the previously detected audio configuration. Once all of the PCM samples based on the previously detected audio configuration have been emptied from the PCM ring buffer 308, the method flow moves to block 408 and the transcoder control module 312 resets the encoder 310 to a state whereby it can encode data according to the newly detected audio configuration. The transcoder control module 312 can also update the audio channel mapping 320 to reflect the new number of audio channels. The method flow moves to block 409 and the transcoder 100 transcodes the audio portion of the input stream according to the newly detected audio configuration.

In an embodiment, the transcoder control module 312 uses a set of flags 315-317 (FIG. 3) to synchronize the reconfiguration of the audio decoder and audio encoder, thereby reducing potential transcoding errors. For example, absence of synchronization increases the likelihood that audio encoder will encode a PCM sample with an incorrect number of audio channels, thereby causing errors in the output stream. The flags 315-317 include a change pending flag 315, a change done flag 316, and an encoder ready flag 317. These flags can be set and cleared to indicate the relative configuration change status of the audio encoder and decoder 307 and audio encoder 310. This can be better understood with reference to FIGS. 6 and 7.

Figure 6:
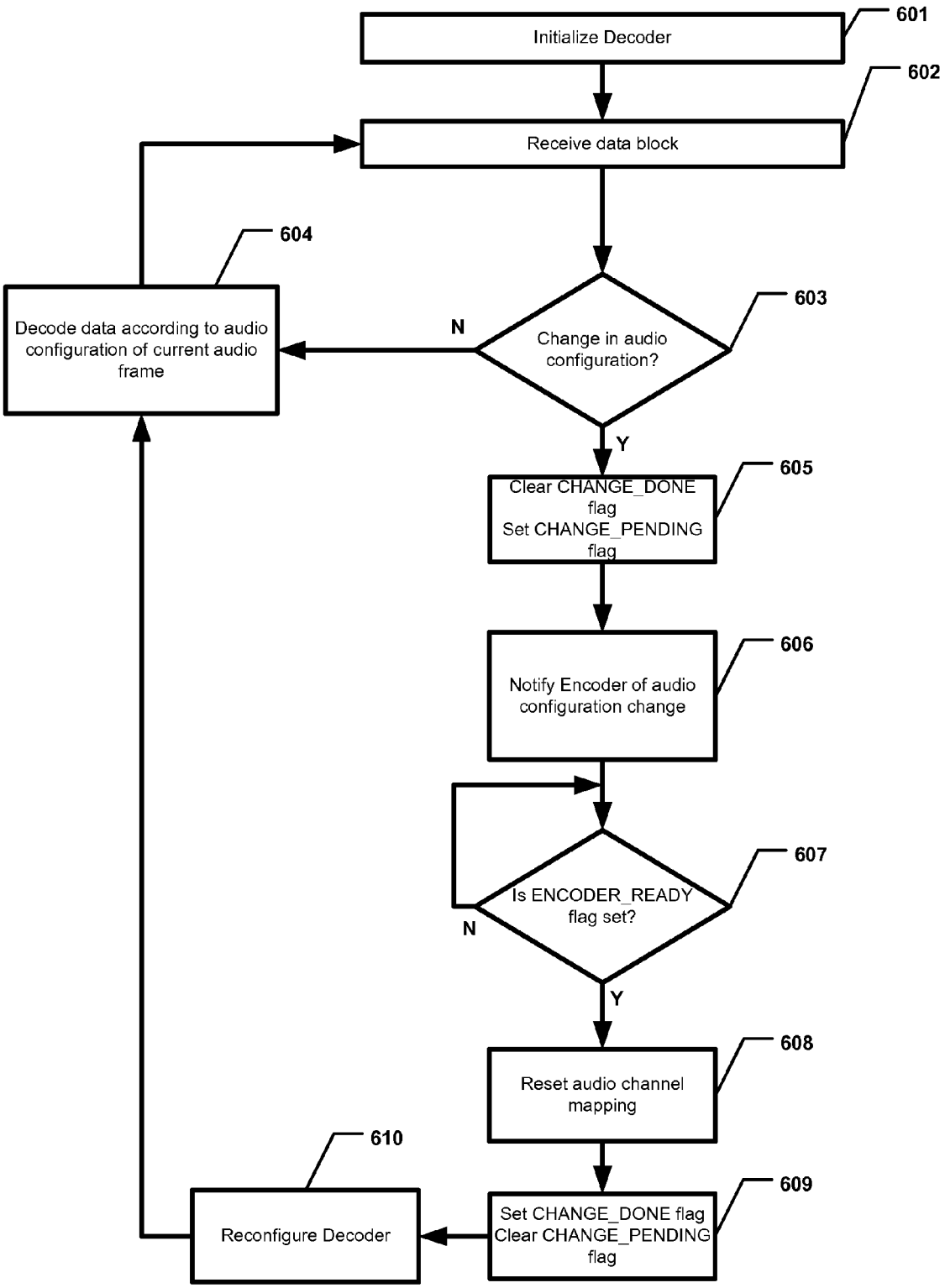
FIG. 6 is a flow diagram of a method of configuring the decoder of FIG. 2 in response to a change in audio configuration for the input stream in accordance with one embodiment of the present disclosure.

FIG. 6 illustrates a method of reconfiguring the audio decoder 307 in response to a change in audio configuration of the input stream in accordance with one embodiment of the present disclosure. At block 601 the audio decoder 307 is initialized. At block 602 a data block is received at the transcoder 100. At block 603, the transcoder 100 determines whether there has been a change in the audio configuration for the input stream, in similar fashion to that described above with respect to FIG. 4. If there has been no change in audio configuration, the method flow moves to block 604 and the audio decoder 307 continues to decode audio samples stored at the buffer according to the previously detected audio configuration, and in particular the previously detected number of audio channels.

If the transcoder 100 determines a change in audio configuration has occurred, such that the data blocks of the input stream are associated with a different number of audio channels than previously determined, the method flow moves to block 605 and the transcoder control module clears the change done flag 316 and sets the change pending flag 315. In response to the flags being set to this state, the audio encoder 310 is notified that there is a pending change in the audio configuration for the input stream. This results in the encoder 310 emptying the PCM ring buffer 308 of samples and then reconfiguring itself to encode based on the new audio configuration, as described below with respect to FIG. 7. In another embodiment, the audio encoder 310 employs a task queue (not shown) indicating the current audio encoding format and audio configuration according to which the encoder encodes data. The audio encoder 310 is notified of the change in audio configuration by the audio decoder 307 or the transcoder control module 312 placing a task in the task queue indicating the change in audio configuration.

Once the audio encoder 310 has reconfigured itself to encode according to the new audio configuration, it will set the encoder ready flag 317. Accordingly, at block 607 the transcoder control module 317 periodically polls the encoder ready flag 317. Once the flag 317 is in the set state, the method flow moves to block 608 and the transcoder control module 312 or the audio decoder 307 stores, at the audio channel mapping 320, the channel mapping indicated by the new audio configuration. The stored channel mapping can be accessed by the modules of the transcoder 100, including the audio decoder 307 and the audio encoder 308, to determine the appropriate procedure to decode and encode the input stream. At block 609, the transcoder control module 312 sets the change done flag 316 and clears the change pending flag 315. At block 310, the audio decoder 307 reconfigures itself so that the new number of audio channels indicated by the new audio configuration will be properly decoded. The method flow returns to block 604, and the decoder retrieves samples from the decode ring buffer 306 and decodes the samples according to the new number of audio channels indicated by the new audio configuration.

Figure 7:
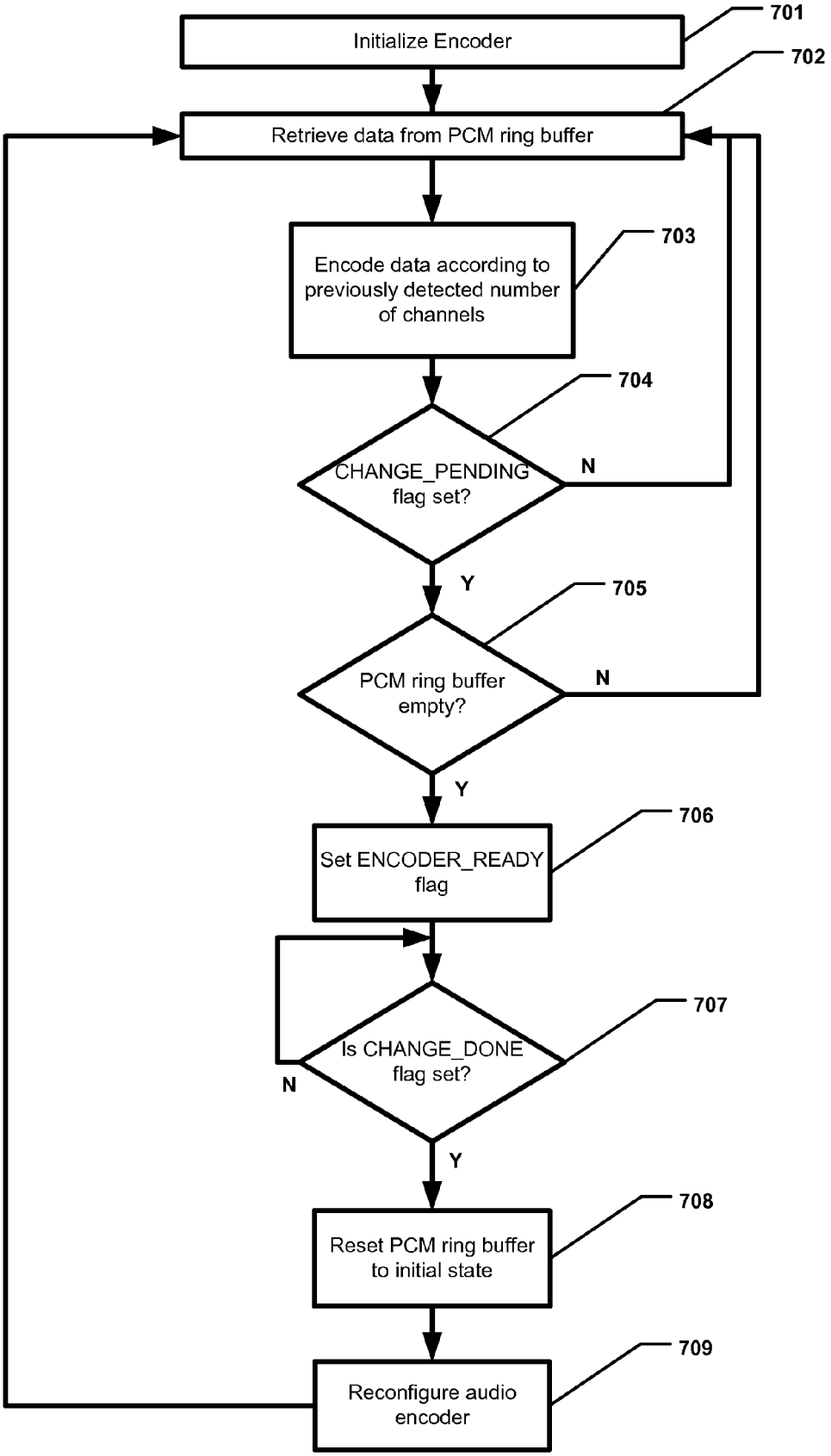
FIG. 7 is a flow diagram of a method of configuring the encoder of FIG. 2 in response to a change in audio configuration for the input stream in accordance with one embodiment of the present disclosure.

FIG. 7 illustrates a method of reconfiguring the audio encoder 310 in response to a change in audio configuration of the input stream in accordance with one embodiment of the present disclosure. At block 701 the audio encoder is initialized. At block 702, the audio encoder 310 retrieves a PCM sample from the PCM ring buffer 308. In an embodiment, the retrieved sample can be resampled at a different sampling rate at resampling module 309 prior to provision to the audio encoder 310. At block 703, the audio encoder 310 encodes the retrieved sample based on the currently stored audio channel mapping. At block 704, the audio encoder 310 determines whether the change pending flag 315 is set, indicating the audio configuration of the input stream has changed. If not, the method flow returns to block 702 and another PCM sample is retrieved.

If the change pending flag 315 is set, the method flow moves to block 705 and the audio encoder 310 determines whether the PCM ring buffer 308 is empty of samples. If not, this indicates there are still samples at the PCM ring buffer that are associated with the previous audio configuration. Accordingly, the method flow returns to block 702 to retrieve another audio sample for encoding under the previous channel mapping. Once all of the samples decoded under the previous channel mapping have been retrieved, the method flow moves to block 706 and the audio encoder 310 sets the encoder ready flag 317. At block 707, the audio encoder 310 determines whether the audio decoder 307 has completed resetting the audio channel mapping to the new audio configuration. If not, the encoder enters a wait state until the audio channel mapping has been reset.

In response to the audio decoder 307 resetting the audio channel mapping, the method flow moves to block 708 and the transcoder control module resets the PCM ring buffer 308 to an initial state. In particular, the read and write pointers for the buffer 308 are set to their initial state to begin storage of samples. At block 709 the transcoder control module reconfigures the audio encoder 310 so that it can encode the audio information of the input stream according to the new channel mapping. The method flow returns to block 702 and the encoder receives the next PCM sample for encoding.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The use of the term "set" and "clear" with respect to a flag does not indicate a particular logic value for the flag, but rather the state that the value represents. Accordingly, in some embodiments a flag can be set with a logic value of 1 and cleared with a logic value of 0, while in other embodiments, a logic value of 1 indicates a cleared state and a logic value of 0 indicates a set state.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A method comprising:

transcoding an input encoded stream at a transcoder to generate an output encoded stream, wherein transcoding the input encoded stream comprises:

decoding, at a decoder of the transcoder, audio samples of the input encoded stream to corresponding decoded audio samples;

buffering the decoded audio samples at a buffer; and accessing, by an encoder of the transcoder, the decoded audio samples from the buffer and encoding the accessed decoded audio samples to generate encoded audio samples for the output encoded stream based on an audio configuration of the input stream; and in response to a change in audio configuration of the input stream from a first number of audio channels to a second number of channels, automatically reconfiguring the transcoder to transcode the input stream according to the second number of channels, wherein automatically reconfiguring the transcoder comprises:

resetting the decoder to implement a modified configuration for the changed audio configuration; and delaying implementation of a reconfiguration of the encoder until the encoder has emptied the buffer of decoded audio samples while the decoder is being reset.

2. The method of claim 1, further comprising:

detecting the change in audio configuration at the transcoder.

3. The method of claim 2, wherein detecting the change in the audio configuration comprises:

determining an encoding format for the input stream;

mapping a set of audio channels associated with the encoding format to a set of predefined tags to determine a channel mapping; and detecting the change in the audio configuration based on the channel mapping.

4. The method of claim 3, wherein detecting the change in the audio configuration comprises comparing the channel mapping to a stored channel mapping.

5. The method of claim 4, further comprising determining the stored channel mapping based on the first number of channels.

6. The method of claim 1, wherein reconfiguring the transcoder further comprises:

setting a first flag in response to determining the change in audio configuration; and in response to the first flag being set, determining whether the buffer is empty of decoded audio samples.

7. The method of claim 6, further comprising:

setting a second flag in response to determining the buffer is empty of decoded audio samples; and in response to the second flag being set, modifying stored channel mapping information to reflect the second number of channels.

8. The method of claim 7, further comprising clearing the first flag in response to modifying the stored channel mapping information.

9. The method of claim 1, further comprising resetting the buffer to an initial state in response to emptying the buffer of decoded audio samples, the initial state reflecting an empty buffer state.

10. The method of claim 1, wherein:

the decoded audio samples have a pulse code modulated (PCM) format; and the encoded audio samples have one of: a motion pictures experts group (MPEG) format and an advanced audio coding (AAC) format.

11. A method, comprising:

in response to determining a change in a number of audio channels included in an input stream received at an input pf a decoder module of a transcoder, synchronizing reconfiguration of the decoder module and an encoder module to transcode the input stream, wherein synchronizing reconfiguration comprises:

resetting the decoder module to implement a modified configuration for the change in the number of audio channels; and waiting to reconfigure the encoder module until the encoder module has completed encoding a buffered set of decoded audio samples received from the decoder module prior to resetting the decoder module.

12. The method of claim 11, further comprising determining the change in the number of audio channels by mapping a set of audio channels included in the received input stream to a set of tags to determine a mapped set of tags, and determining whether there has been a change in the mapped set of tags relative to a previously mapped set of tags.

13. The method of claim 11, wherein the change in the number of audio channels represents a change in television programs represented by the input stream.

14. A device comprising:

a transcoder to transcode an input encoded stream to generate an output encoded stream, the transcoder comprising:

a decoder to decode audio samples of the input encoded stream to corresponding decoded audio samples;

a buffer coupled to the decoder, the decoder to buffer the decoded audio samples; and an encoder coupled to the buffer, the encoder to access the decoded audio samples from the buffer and encode the accessed decoded audio samples to generate encoded audio samples for the output encoded stream based on an audio configuration of the input stream; and in response to a change in audio configuration of the input stream from a first number of audio channels to a second number of channels, the transcoder is configured to automatically reconfigure for transcoding the input stream according to the second number of channels by:

resetting the decoder to implement a modified configuration for the changed audio configuration; and delaying implementation of a reconfiguration of the encoder until the encoder has emptied the buffer of decoded audio samples while the decoder is being reset.

15. The device of claim 14, wherein the transcoder is to:

determine an encoding format for the input stream;

map a set of audio channels associated with the encoding format to a set of predefined tags to determine a channel mapping; and detecting the change in the audio configuration based on the channel mapping.

16. The device of claim 15, wherein the transcoder is to detect the change in the audio configuration by comparing the channel mapping to a stored channel mapping.

17. The device of claim 16, wherein the transcoder is to detect the stored channel mapping based on the first number of channels.

18. The device of claim 14, wherein:

the decoded audio samples have a pulse code modulated (PCM) format; and the encoded audio samples have one of: a motion pictures experts group (MPEG) format and an advanced audio coding (AAC) format.

* * * * *